United States Patent [19]

Buchholz

[11] 4,121,350

[45] Oct. 24, 1978

[54] SHEET DRYER APPARATUS USING DEFLECTORS FOR STEAM DRYING

[76] Inventor: Adolf Buchholz, 11694 SE. Clover La., Portland, Oreg. 97266

[21] Appl. No.: 781,936

[22] Filed: Mar. 28, 1977

Related U.S. Application Data

[63] Continuation-in-part of Ser. No. 550,573, Feb. 18, 1975, Pat. No. 4,026,037.

[51] Int. Cl.[2] ..... F26B 21/06; F26B 13/30; F26B 25/06

[52] U.S. Cl. ..... 34/77; 34/92; 34/212; 34/216; 34/219

[58] Field of Search ..... 34/26, 77, 92, 148, 34/151, 212, 213, 215, 216

[56] References Cited

U.S. PATENT DOCUMENTS

| | | | |
|---|---|---|---|
| 2,284,838 | 6/1942 | Oholm | 34/213 |
| 2,296,546 | 9/1942 | Toney | 34/26 X |
| 2,758,386 | 8/1956 | Cobb | 34/213 |
| 2,981,528 | 4/1961 | Culp | 34/212 X |
| 3,474,544 | 10/1969 | Holden, Jr. et al. | 34/216 |
| 3,882,612 | 5/1975 | Try et al. | 34/216 |
| 4,026,037 | 5/1977 | Buchholz | 34/57 R |

*Primary Examiner*—John J. Camby
*Attorney, Agent, or Firm*—Klarquist, Sparkman, Campbell, Leigh, Hall & Whinston

[57] ABSTRACT

A dryer apparatus is disclosed for drying sheet materials by contact with a drying fluid which is deflected towards the opposite surfaces of the sheet by deflector members spaced longitudinally along such sheet. A major portion of the drying fluid consists of internally generated superheated drying steam above 212° F, to vaporize the water in the sheet material and remove it to produce the steam used for drying. A minor portion of steam is removed from the drying fluid and discarded to maintain pressure equilibrium. The drying steam is produced within the drying chamber from water evaporating from the material being dryed and is either heated to form the superheated steam within the drying zone where it is in contact with the sheet material or is removed from the drying zone, heated to form superheated steam and returned to the drying zone for contact with the sheet material during drying. A wood veneer dryer employing the invention is described including two drying chambers having their drying fluids flowing in opposite directions through the drying zones within such chambers. A crossover section is provided between the two chambers to cause the drying fluids to cross from one drying zone to another. The drying zones provided with the veneer dryer have at least along the major portions of their lengths a negative internal pressure which is below that of the ambient external atmosphere outside the dryer to prevent pollutants from leaking out of the dryer and ambient air is prevented from entering the dryer into such drying zones.

20 Claims, 5 Drawing Figures

SHEET DRYER APPARATUS USING DEFLECTORS FOR STEAM DRYING

RELATED PATENT APPLICATION

The present application is a continuation-in-part of pending U.S. Patent application Ser. No. 550,573, filed Feb. 18, 1975, now U.S. Pat. No. 4,026,037, by A. Buchholz, entitled "Apparatus and Method for Steam Drying."

BACKGROUND OF INVENTION

The present invention relates to a dryer apparatus for drying water-containing sheet materials. More particularly, the present invention relates to a sheet dryer apparatus for drying by contacting the sheets with internally generated superheated steam in a drying zone while preventing ambient air from entering such drying zone. In one aspect, the present invention relates to a wood veneer dryer.

Wood veneer is normally dried by passing large volumes of hot air over the veneer sheets. The water content of the hot air is usually about five percent, but may be as high as 30 percent or more in unusual cases. When overly hot air contacts the veneer, the surface of the veneer begins drying immediately and very rapidly dries out completely, becoming overly hot, while the interior of the veneer is still relatively cool and moist. This temperature gradient, and the resulting moisture gradient in the veneer cause hardening, cracking and general degradation of the veneer. For this reason, the wood veneer drying art has resorted to relatively low drying air temperatures and long drying times.

It is desirable to have a uniform moisture content in the veneer after drying is completed. In conventional veneer drying the outer surface of the veneer is overly dry after drying is completed, while the interior of the veneer remains overly moist. Moreover, sheets of veneer dried at different times in the same dryer often have different moisture contents, making it difficult to glue the veneer uniformly to produce plywood.

A major problem in the veneer drying art has been disposal of large amounts of hydrocarbonaceous vapors which are evolved from the veneer during drying. The hydrocarbonaceous vapors are removed from the veneer by hot air in the dryer and carried out of the dryer up a smoke stack along with the air. In the past, after the hot air has been used in drying, it has simply been discarded up the stack and released into the atmosphere. In addition, much of hydrocarbon vapor leaks out of door seals and cracks in the veneer dryer as "fugitive emissions" because of the positive pressure created within the dryer. This has caused severe air pollution problems. Under present environmental restrictions, it has become necessary to curb release into the atmosphere of such hydrocarbonaceous vapors.

Another problem of prior veneer dryers has been the lack of efficient use of the hot air or other drying fluid in contacting the veneer sheets. This problem has been partially solved by "jet" type dryers with nozzles or jets for directing the drying fluid against the surfaces on opposite sides of the sheet. However, such jet dryers are extremely expensive.

These problems of efficient drying, pollution control and energy waste are overcome by the steam drying method and apparatus of the present invention. While superheated steam has been used previously in batch drying systems for conditioning and drying heavy lumber and has been suggested for increased humidity to prevent fires in the operation of veneer dryers along with reduced air in flow for heat conservation, as discussed by S. E. Corder in *Forest Products Journal,* October 1963, pages 449 to 453, it has not been employed along with means for producing a negative internal pressure within the drying chamber in continuous production drying systems such as those used for drying wood veneer to prevent the fugitive emission of pollutants from such chamber into the plant containing such dryer.

SUMMARY OF INVENTION

It is an object of the present invention to provide a sheet dryer apparatus for drying water-containing sheet materials in a more rapid and efficient manner than possible using conventional drying systems.

It is another object of the present invention to provide such a dryer apparatus employing a drying medium consisting essentially of internally generated superheated steam and which prevents ambient air from entering the drying zone.

It is a further object of the invention to provide such a dryer apparatus which conserves heat energy loss and reduces atmospheric pollution from pollutants stripped from a material during drying.

An additional object of the present invention is to provide such a dryer apparatus for drying a water-containing sheet material to a substantially uniform water content at the surface and in the interior of the material.

It is still another object of this invention to provide a veneer dryer having increased production capacity while also reducing breakdown and degradation of the dried veneer.

It is a still further object of this invention to provide a veneer dryer which employs deflector members to deflect the drying fluid into contact with the surfaces of the veneer for more efficient drying.

DRAWINGS

Other objects and advantages of the present invention will be apparent from the following detailed description of certain preferred embodiments thereof and from the attached drawings of which:

DESCRIPTION OF PREFERRED EMBODIMENT

Figure 1:
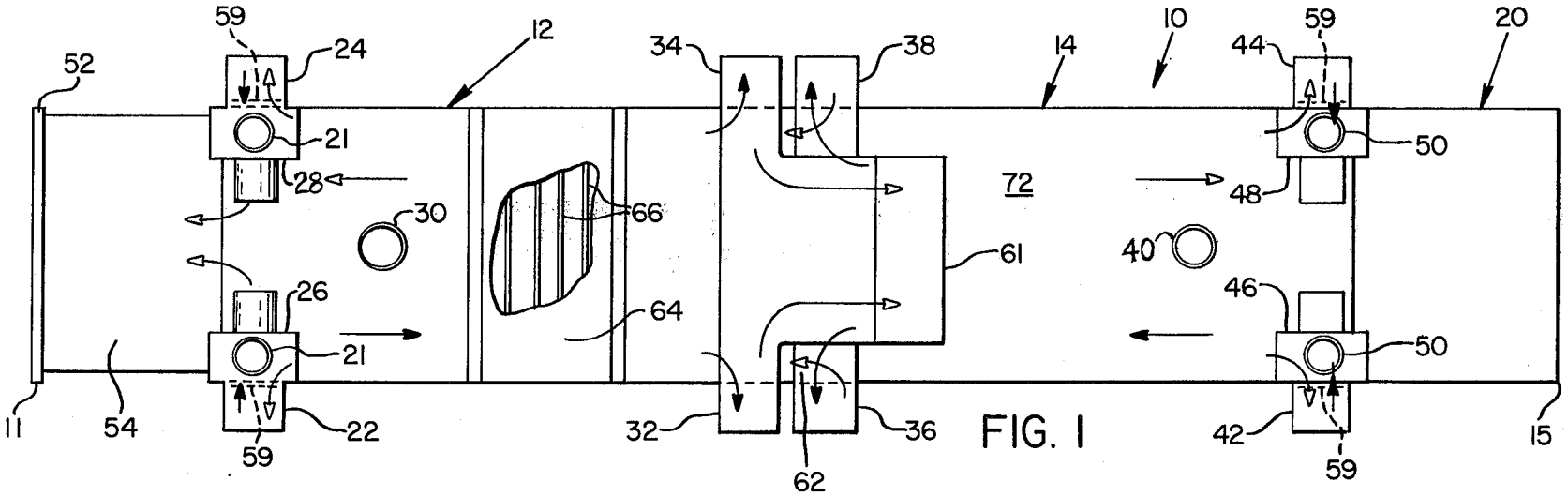
FIG. 1 is a top view of a veneer dryer which has been modified for drying veneer sheets according to the present invention, the flow of drying air in its former conventional operation being depicted by solid arrows, and the flow of superheated steam after modification according to the present invention being shown by outlined arrows.

The present invention may be employed for drying a variety of sheet materials.

This invention is particularly adapted for drying wood veneer to be used in making plywood. The use of the present invention in drying veneer sheets can best be understood by reference to FIGS. 1 and 2 which show a veneer dryer 10 in accordance with a preferred embodiment of the present invention. Green or undried sheets of wood veneer are introduced into the dryer 10 at an inlet end 11 thereof, moving into a green end drying section 12. Sheets pass longitudinally through the dryer 10 from green end drying section 12 into dry end drying section 14. The dried veneer sheets exit from drying section 14 into a conventional veneer cooler 20, attached to the outlet of drying section 14 and are ultimately withdrawn at the outlet end 15 of dryer 10.

At the inlet end of green end drying section 12, the dryer 10 is provided with two laterally attached, vertically extending heating gas ducts 22 and 24 on opposite sides of drying section 12. Vertical ducts 22 and 24 lead, respectively, into two blower fan housings 26 and 28, which are mounted on the roof of drying section 12 and are each provided with an exhaust stack 21 extending from the top of the fan housings. A conventionally placed exhaust stack 30, not utilized in the present invention, is shown extending upwardly from the top of green end drying section 12. Green end drying section 12 has two vertically extending ducts 32 and 34 positioned on opposite sides thereof at its outlet end near the center of dryer 10.

Dry end drying section 14 is likewise equipped with two laterally positioned vertically extending ducts 36 and 38, on opposite sides of its inlet end near the center of dryer 10. A conventionally placed stack 40, not utilized in the present invention, is shown extending upwardly from the roof of drying section 14. Dry end drying section 14 is equipped, on opposite sides of the outlet end thereof, with two laterally positioned, vertically extending ducts 42 and 44. Ducts 42 and 44 are respectively connected to two blower fan housings 46 and 48, which are mounted on the roof of drying section 14. Another exhaust stack 50, employed to withdraw heating steam from the outlet end of veneer dryer 10 according to the present invention, extends upwardly from the top of each of the fan housings 46 and 48.

Figure 2:
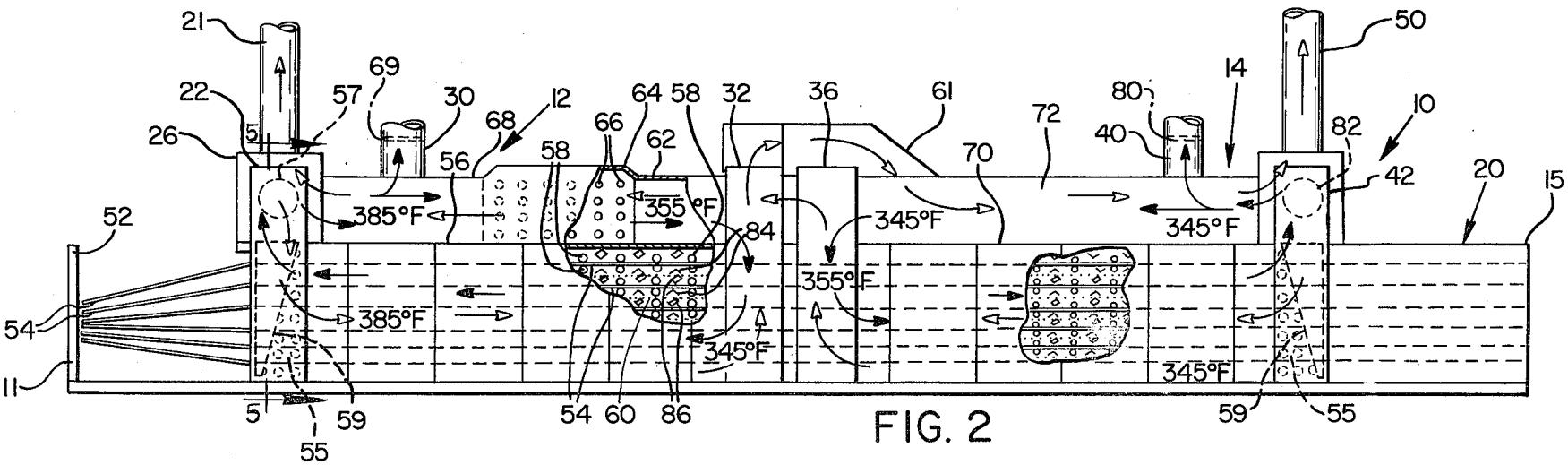
FIG. 2 is a side view of the embodiment shown in FIG. 1 with parts broken away for clarity.

Referring to FIG. 2, a dryer entrance frame 52 is provided at the inlet end 11. A plurality of veneer sheets 54 are introduced through the inlet end 11 into the drying zone provided within a drying chamber 56, which occupies the bottom part of green end drying section 12.

Figure 5:
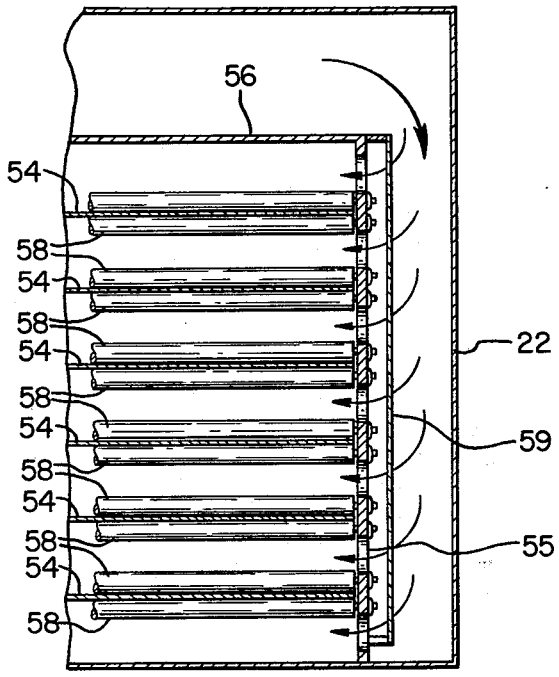
FIG. 5 is a vertical section view taken along the line 5—5 of FIG. 2.

Vertical duct 22 is provided with an internal manifold apparatus including an apertured manifold plate 55 shown in FIG. 5, for introducing superheated drying steam in a plurality of paths between veneer sheets 54 at the entrance to drying chamber 56. The drying steam is forced downwardly into duct 22 by a gas impelling means such as a blower fan 57 mounted within fan housing 26. Vertical duct 24 is likewise equipped with manifold apparatus (not shown) for directing superheated drying steam in plural paths between veneer sheets 54. Drying steam is likewise forced downwardly through duct 24 by a blower fan within housing 28, identical to blower fan 57. Trapezoidal shaped baffle plates 59 (shown in broken lines in FIG. 2 for duct 22) are provided over the apertured manifold plates 55 in the ducts 22 and 24. Ducts 42 and 44 are also provided with apertured manifold plates 55 and baffle plates 59. These baffle plates 59 have a wide top and taper to a narrow bottom where they do not block as much of the manifold plate, and thereby increase the amount of steam entering the bottom of the inlet and outlet ends, respectively, of the drying chamber 56 and of drying chamber 70 included in dry end drying section 14 to better prevent the entry of ambient air.

Veneer sheets 54 are conveyed through green end drying chamber 56 between horizontal rows of vertically and longitudinally spaced conveyor rollers 58, which are conventional in design, their operation being well known in the veneer drying art. Drying sections are normally of the order of 50 feet in length or more. Drying chamber 56 is further equipped with heat exchange pipes 60, through which a suitable heat exchange fluid, such as boiler steam at 250 p.s.i. pressure, is passed to heat the drying steam as it passes through chamber 56 between veneer sheets 54.

In operation of green end drying section 12 according to the present invention (the desired flow being indicated by outlined arrows), a drying gas consisting essentially of superheated drying steam at a dry bulb temperature above 212° F is blown downwardly through ducts 22 and 24. A minor portion of the drying steam is withdrawn from green end drying section 12 and passed from the fan housing out through stacks 21. Being relatively hot and light, this portion of the superheated steam rises and passes upwardly through stacks 21 for exhausting to the atmosphere. The small amount of steam removed via stacks 21 may be treated, in any desired manner, to remove pollutants before it is discharged. A major portion of super-heated drying steam blown into ducts 22 and 24 is conveyed into drying chamber 56 between the plurality of sheets 54 of wood veneer therein. The superheated drying steam passes to the right downstream through chamber 56 toward ducts 32 and 34. The heat of the superheated steam passing through chamber 56 is maintained at the desired temperature by heat exchange contact with pipes 60 spaced throughout chamber 56.

At the outlet end of chamber 56, the used drying steam is withdrawn from chamber 56 into vertical ducts 32 and 34. The used steam from the green end drying section 12 is passed upwardly through ducts 32 and 34 into a duct 61 forming part of a crossover means which conveys the steam across to the dry end drying section 14 and through a horizontal top duct 72 positioned above drying chamber 70. In a similar manner the used steam from the drying section 14 is passed from the inlet of its drying chamber 70 upward through ducts 36 and 38 into the other drying section 12 through a horizontal top duct 62. The duct 62 conveys such steam through a superheated heat exchanger 64 positioned above drying chamber 56.

As shown in the cutaway portions of FIGS. 1 and 2, heat exchanger 64 is equipped with a plurality of conventional, finned, closely spaced heat exchange pipes 66, through which a suitable high temperature heat exchange fluid, such as the same pressurized steam in pipes 60, is passed in order to heat the used drying steam from duct 62 to the desired high temperature of, for example, about 385° F. The heated drying steam is withdrawn from heat exchanger 64 through a horizontal duct 68 and returned to fan housings 26 and 28 as recycled steam. The recycled drying steam is then fed into vertical ducts 22 and 24 and into the inlet of the drying chamber 56 at a temperature of about 385° F, as described above. According to the present invention, the conventional exhaust stack 30 is completely blocked off by baffle 69. Therefore, no ambient air will be drawn through stack 30 into duct 68 even though there is a subatmospheric pressure in duct 68.

Gas impeller means, in this case blower fan at the inlet end of green end drying section 12, including blower fan 57 in fan housing 26 and the fan (not shown)

in housing 28 are used to move the steam throughout drying section 12. These fans produce a slightly higher-than-ambient pressure stream of superheated steam in vertical ducts 22 and 24. This slightly positive pressure is rapidly dissipated after the steam is passed between the veneer sheets 54 into drying chamber 56 and extends over only a minor portion of the length of the drying chamber 56 from its inlet end. Within chamber 56, suction from the blower fans creates a slightly less-than-ambient pressure extending from a point adjacent the inlet end of chamber 56 throughout the major portion of chamber 56, ducts 32 and 34, duct 62, and, to some degree, through heat exchanger 64. As steam passes through heat exchanger 64 it is heated. The fans force out steam at higher-than-ambient pressure into the heating gas ducts 22 and 24 to insure that no ambient air enters the inlet of drying chamber 56. The positive pressure at the inlet end of chamber 56 blocks air entry.

Operation of the dry end section 14 of veneer dryer 10 is similar to that of green end section 12. Drying section 14 includes a drying zone in a drying chamber 70, which contains conventional conveyor rollers 58 and heat exchange pipes 60 like those in green end drying chamber 56. The flow of superheated drying steam through drying chamber 70 (shown by outlined arrows) is to the left toward vertical ducts 36 and 38. Used drying steam at a temperature of about 355° F withdrawn from chamber 70 is passed upwardly through ducts 36 and 38 into the horizontal duct 62 to the green end drying section 12, as described above. Similarly the used drying steam at a temperature of about 345° F withdrawn from chamber 56 is passed upwardly through ducts 32 and 34 and through a crossover duct 61 into a horizontal duct 72 to dry end drying section 14. The steam is passed from duct 72 into fan housings 46 and 48 and into the outlet end of chamber 70 at a temperature of about 345° F. According to the present invention, conventionally placed stack 40 is completely sealed by emplacement of baffle 80. Therefore, no ambient air will be drawn through stack 40 into duct 72 even though there is a subatmospheric pressure in this duct.

Fan housing 46 is equipped with a blower fan 82. Fan housing 48 is equipped with an identical blower fan (not shown). Heated drying steam conveyed from duct 72 into housings 46 and 48 is blown by the blower fans downwardly through vertical ducts 42 and 44 into dry end drying chamber 70. The drying steam blown into ducts 42 and 44 is conveyed into chamber 70 through a manifold apparatus similar to that of FIG. 5, in duct 42 and similar manifold apparatus in duct 44 into a plurality of paths between the sheets 54 of veneer, to evenly distribute the steam throughout chamber 70. A minor portion of the superheated steam directed downward through ducts 42 and 44 is withdrawn from the downstream end of drying section 14 and passed from the fan housing out through stacks 50. This small amount of steam being hot and light, rises and passes upwardly through stacks 50 for exhausting to the atmosphere after appropriate pollution control treatment.

Previously, veneer dryers have been constructed to operate by passing hot air over wood veneer sheets in the manner depicted by the solid arrows in FIGS. 1 and 2. The blowing and heating arrangements, as well as air flow, in conventional dryers have been essentially opposite to that employed in the drying method and apparatus of this invention. Prior art veneer dryers have not been equipped with manifolds in ducts 22, 24 and 42, 44, crossover ducts 61 and 62 or stacks 21 and 50 shown on dryer 10. Instead, for example, in operation of a green end drying section, such as section 12, ambient outside air has been drawn into the inlet end of the dryer and upward into ducts, such as ducts 22 and 24, where the outside air has been mixed with hot air recovered from the drying chamber, such as chamber 56. A large portion of the resulting mixture of used hot air and fresh outside air has then been exhausted from the dryer through a conventionally placed stack, such as stack 30 in section 12. This creates severe problems due to the loss of heat energy and the large amount of pollutants emitted into the atmosphere. The remainder of the air mixture has then been passed through a heat exchange chamber, such as chamber 64, and through ducts, such as duct 62 and ducts 32 and 34, into a drying chamber such as chamber 56.

Figure 3:
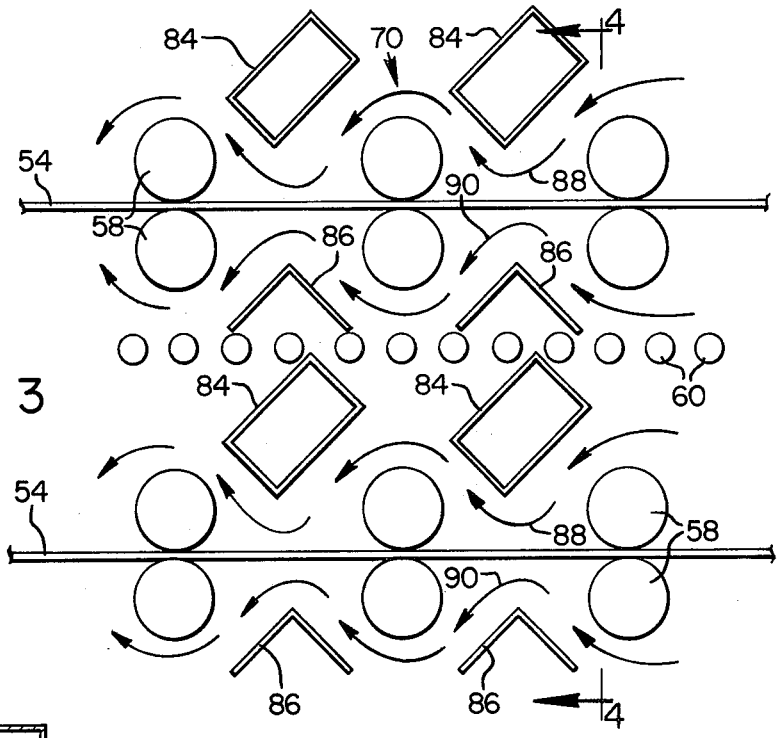
FIG. 3 is an enlarged view of a portion of the drying chamber at the right side of the dryer of FIG. 2.
Figure 4:
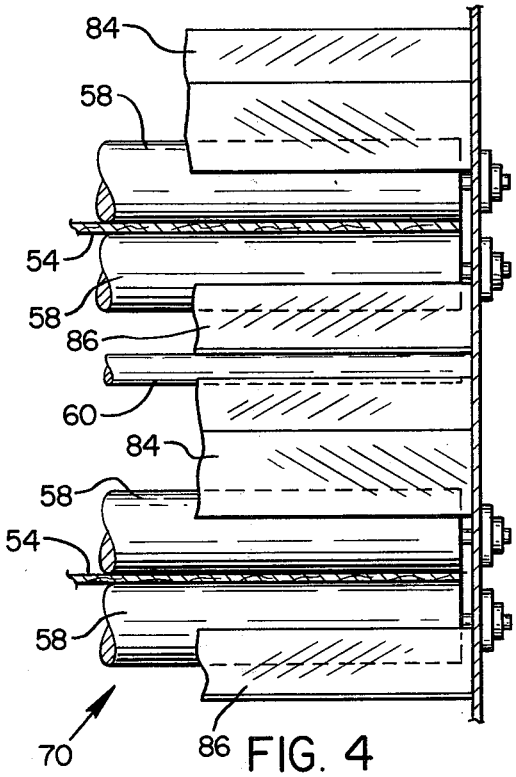
FIG. 4 is a vertical section view taken along the line 4—4 of FIG. 3.

As shown in FIGS. 3 and 4, a plurality of top deflector baffles 84 and bottom deflector baffles 86 are provided on opposite sides of each horizontal row of conveyor rollers 58. The deflector baffles extend laterally across the veneer sheet and are spaced apart longitudinally along the sheet. Such deflector baffles vertically deflect the stream of drying fluid normally flowing horizontally across the sheet, toward opposite surfaces of such sheet as shown by solid arrows 88 and 90 for greater contact with the sheet and more efficient drying.

The bottom deflector baffles 86 are of an inverted V-shaped cross section, while the top deflector baffles 84 are of a hollow rectangular cross section so they provide no dirt collecting surfaces. It should be noted that in some cases heat exchange pipes 60 are not present in which case the deflector baffles 84 and 86 can be formed by a single baffle of a generally sideways V-shaped cross section pointing upstream of the drying fluid flow.

By reversing the flow of the drying fluid in accordance with the present invention and passing drying steam away from the inlet end and outlet end, respectively, of drying chambers 56 and 70, substantially the whole of drying chambers 56 and 70 are maintained at less-than-ambient atmospheric pressure by the suction of the fans. Leakage of any pollutant-laden drying gas outward through door seals and cracks in the walls of chambers 56 and 70 into the atmosphere around veneer dryer 10 is thereby prevented. In contrast, conventional veneer dryer operations have been troubled by "fugitive emission" leakage of pollutant-laden drying air into the ambient atmosphere from the drying chamber due to the positive pressure created within such chambers.

Drying conditions other than those specified herein for use in carrying out this invention in veneer dryers such as dryer 10 are known in the veneer drying art. For example, the length of time to which veneer sheets are subjected to drying depends upon the moisture content of the particular wood before drying and also upon the moisture content desired for the dried veneer. The exact temperature of the super-heated steam above 212° F and the time period employed can be selected to obtain a desired moisture content in the dried veneer. Usually, good results are obtained by maintaining the drying steam at a dry bulb temperature above about 240° F and a wet bulb temperature as close as feasible to 212° F. Particularly good results may be achieved using drying steam at a dry bulb temperature between about 350° F and 400° F and a wet bulb temperature as close to 212° F as can be obtained.

By using a drying gas consisting essentially of superheated steam at a high wet bulb temperature, I have been able to substantially increase the production capacity of a conventional veneer drying unit, e.g., by 25 percent or more, when it has been modified in accordance with the present invention. Increases in production capacity of as much as 40 percent have been obtained. Although not essential to an understanding of the present invention, I believe that such striking improvement in capacity and efficiency in veneer drying obtained using the present process and apparatus is due, at least in part, to the superior ability of superheated steam to transmit heat to liquid water contained in the veneer sheets, as compared with conventional hot air. Not only do the present process and apparatus substantially decrease the amount of time necessary to dry veneer sheets, but the dried veneer product produced according to the present invention also has a more uniform moisture content than is found in dried veneer produced according to conventional methods.

An important aspect of the present drying process, as used for drying wood veneer, is the continuous recirculation or recycling of a drying gas consisting essentially of superheated steam, with only a small portion of the heated steam being continuously withdrawn from the drying apparatus and discarded. Preferably, the minor portion of steam which is thus discarded contains an amount of water substantially equal to the amount of water evaporated from the veneer sheets and the volume of air in the discarded steam is substantially equal to the leakage of air into the dryer. Water from the sheets forms additional steam which is mixed with the remaining superheated drying steam that was previously formed in a similar manner within the drying chamber. In this way, the pressure of the system and the steam flow rate are automatically regulated at a proper level. By exhausting this portion, the amount of circulating steam is kept constant, so that the pressure is also constant inside the system.

An important feature of the invention in veneer dryers is heating the drying steam when it is removed from drying zones, such as drying chambers 56 and 70, before it is reintroduced into such zones by the blower fan or other gas impelling means. The impeller then provides a positive pressure at the inlet and the outlet to the dryer to prevent entry of ambient air, while suction from the impeller provides a negative pressure within the drying zones. The system provides automatic bleeding of substantially all of the moisture which is removed from the veneer sheet within the drying zone. This small amount of exhaust steam or gas can easily and inexpensively be treated for pollution control, e.g., removal of hydrocarbonaceous vapors before being released into the atmosphere.

The practice of the drying method of this invention as used for drying wood veneer sheets is not restricted to the longitudinal flow veneer dryer apparatus depicted in FIGS. 1 and 2. Substantially any conventional veneer drying apparatus may be converted to the practice of the present invention by alterations therein shown in FIGS. 1 and 2. For example, the method of the present invention may be utilized in veneer dryers employing cross flow jet drying systems or other types of conventional drying apparatus.

It will be obvious to those having ordinary skill in the art that many changes may be made in the preferred embodiment of the present invention. For example, the drying fluid crossover feature can be applied to a jet dryer to provide a more uniform moisture content in which case the deflector baffles would not be employed. Therefore the scope of the present invention should only be determined by the following claims.

I claim:

1. A sheet drying apparatus for removing water absorbed in sheet material comprising:

dryer means having at least one drying chamber for containing said sheet material and including feeder means for moving said material through inlet and outlet ends of said chamber during drying;

heating means for providing a heating fluid within said chamber including water evaporated from said sheet material, said heating fluid flowing through said chamber and consisting of at least a major portion of superheated steam;

deflector means within said chamber for deflecting said heating fluid toward the surface of said sheet material to contact said sheet material with said heating fluid to heat said material and vaporize said water absorbed therein, whereby said water is removed from said material;

means for preventing the entry of ambient air into said chamber through its open ends; and means for producing a negative internal pressure within the chamber along at least the major portion of its length, said negative pressure being below the ambient pressure of the atmosphere surrounding said chamber.

2. Apparatus in accordance with claim 1 in which the deflector means includes a plurality of first deflector members extending laterally across one side of the sheet material and spaced apart longitudinally along said sheet material.

3. Apparatus in accordance with claim 2 in which the deflector means includes a plurality of second deflector members extending laterally across the opposite side of said sheet material and spaced apart longitudinally along said sheet material so that the heating fluid is deflected toward both of the opposite surfaces of said sheet material.

4. Apparatus in accordance with claim 1 in which the means for preventing the entry of ambient air and the means for providing a negative internal pressure both include fan means.

5. Apparatus in accordance with claim 4 wherein said sheet material is a hydrocarbonaceous material which gives off hydrocarbonaceous vapors when heated by said heating fluid in said chamber, whereby said vapors are prevented from leaking out of said chamber by said less than ambient internal pressure in said chamber.

6. Apparatus in accordance with claim 1 in which the feeder means is a conveyor means for continuously transporting said sheet material through said chamber during drying.

7. Apparatus in accordance with claim 1 wherein said sheet material is a wood veneer.

8. Apparatus in accordance with claim 7 in which the dryer also includes a second chamber whose sheet material inlet is connected to the outlet of the first mentioned chamber, said second chamber having a second heating fluid flowing from its outlet to its inlet in a direction opposite to the flow of the first mentioned heating fluid in the first chamber, and crossover means for transmitting said first heating fluid from the outlet of the first chamber to the outlet of the second chamber, and for transmitting said second heating fluid from the inlet of the second chamber through a heat exchanger of the heating means to the inlet of said first chamber.

9. Apparatus in accordance with claim 8 in which the means for producing said negative pressure includes first and second fan means for moving said heating fluids through said dryer away from said inlet of the first chamber and away from said outlet of said second chamber.

10. Apparatus in accordance with claim 9 in which exhaust stacks are provided on fan housings surrounding the fan means.

11. A sheet drying apparatus for removing water absorbed in sheet material comprising:

dryer means having at least two drying chambers including a first chamber at the input section of the dryer and a second chamber at the output section of the dryer for containing the sheet material, and including feeder means for moving said sheet material through inlet and outlet ends of said chambers during drying;

heating means for providing a first heating fluid within the first drying chamber and a second heating fluid within the second drying chamber, said heating fluids consisting of a major portion of superheated steam and flowing through said chambers in opposite directions to heat the sheet material and vaporize the water absorbed therein for removal of said water, said first heating fluid flowing from the inlet to the outlet of the first chamber and the second heating fluid flowing from the outlet to the inlet of the second chamber;

crossover means for transmitting said first heating fluid from the outlet of the first chamber to the outlet of the second chamber, and for transmitting said second heating fluid from the inlet of the second chamber to the inlet of the first chamber; and means for producing a negative internal pressure within the first and second chambers along at least the major portion of their lengths, said negative pressure being below the ambient pressure of the atmosphere surrounding said chambers.

12. Apparatus in accordance with claim 11 which also includes means for preventing the entry of ambient air into said chambers through their open ends.

13. Apparatus in accordance with claim 12 in which the means for preventing the entry of ambient air and the means for providing a negative internal pressure both include common fans means.

14. Apparatus in accordance with claim 13 which includes manifold means at the sides of the inlet of the first chamber and the outlet of the second chamber for transmitting the drying fluids downward and inward between a plurality of vertically spaced sheets of sheet material, and tapered baffle means provided over the outlet of the manifold for reducing the flow of drying fluid to the sheets near the top and increasing the flow of drying fluid to the sheets near the bottom of the drying chamber.

15. Apparatus in accordance with claim 11 in which the heating means includes a heat exchanger outside of said chambers in the crossover path of the second heating fluid from the inlet of the second chamber to the inlet of the first chamber.

16. Apparatus in accordance with claim 15 which also includes a first fan means between the outlet of the heat exchanger and the inlet of the first chamber and a second fan means in the crossover path of said first fluid from the outlet of the first chamber to the outlet of the second chamber.

17. Apparatus in accordance with claim 16 which also includes exhaust stacks provided on fan housings surrounding said first and second fan means.

18. Apparatus in accordance with claim 11 which also includes deflector means within the first and second chambers for deflecting the first and second heating fluids toward the surface of said sheet material to contact the opposite sides of said sheet material with said heating fluids.

19. Apparatus in accordance with claim 11 in which the sheet material is wood veneer.

20. Apparatus in accordance with claim 19 in which the feeder means is a conveyor means for continuously transporting said veneer through said chambers during drying.

* * * * *